US005672571A

United States Patent [19]

Hatakeyama et al.

[11] Patent Number: 5,672,571

[45] Date of Patent: Sep. 30, 1997

[54] GREASE COMPOSITION FOR CONSTANT VELOCITY JOINTS

[75] Inventors: Ko Hatakeyama; Shinya Kondo, both of Fujisawa, Japan

[73] Assignee: Kyodo Yushi Co., Ltd., Tokyo, Japan

[21] Appl. No.: 379,925

[22] Filed: Jan. 27, 1995

[30] Foreign Application Priority Data

Oct. 21, 1994 [JP] Japan ..... 6-256357

[51] Int. Cl.[6] ..... C10M 137/10

[52] U.S. Cl. ..... 508/321; 508/363; 508/372; 508/390; 508/539

[58] Field of Search ..... 252/32.7 R, 32.7 E, 252/55; 508/390, 391, 312, 321, 371, 363, 372, 539

[56] References Cited

U.S. PATENT DOCUMENTS

| | | | |
|---|---|---|---|
| 2,137,494 | 11/1938 | Jolly et al. | 252/55 |
| 2,637,695 | 5/1953 | McKinley | 252/55 |
| 3,095,375 | 6/1963 | Pitman | 252/55 |
| 3,730,895 | 5/1973 | Kjonaas | 252/18 |
| 3,840,463 | 10/1974 | Froeschmann et al. . | |
| 4,089,689 | 5/1978 | Rigdon et al. | 252/55 X |
| 4,759,859 | 7/1988 | Waynick . | |
| 4,787,992 | 11/1988 | Waynick . | |
| 4,830,767 | 5/1989 | Waynick . | |
| 4,840,740 | 6/1989 | Sato et al. | 252/32.7 E |
| 4,902,435 | 2/1990 | Waynick . | |
| 5,126,062 | 6/1992 | Barnes . | |
| 5,160,645 | 11/1992 | Okaniwa et al. | 252/32.7 E |
| 5,207,936 | 5/1993 | Anzai et al. . | |

FOREIGN PATENT DOCUMENTS

| | | |
|---|---|---|
| 59 122597 | 7/1984 | Japan . |
| 62 207397 | 9/1987 | Japan . |
| 4 304300 | 10/1992 | Japan . |
| WO 94/11470 | 5/1994 | WIPO . |

*Primary Examiner*—Prince Willis, Jr.
*Assistant Examiner*—Cephia Toomer
*Attorney, Agent, or Firm*—Oblon, Spivak, McClelland, Maier & Neustadt, P.C.

[57] ABSTRACT

A grease composition for constant velocity joints comprises (a) a base oil; (b) a lithium-containing thickener selected from the group consisting of lithium soap and lithium complex soap; (c) an organic molybdenum compound selected from the group consisting of molybdenum dithiophosphates and molybdenum dithiocarbamates; (d) a zinc dithiophosphate; (e) a sulfur-phosphorus extreme pressure agent free of any metal; and (f) a calcium salt selected from the group consisting of calcium salts of oxidized waxes, calcium salts of petroleum sulfonates and calcium salts of alkyl aromatic sulfonates. The grease composition for constant velocity joints exhibits a substantially improved effect of reducing friction coefficient and a substantially improved effect of reducing the axial force proportional to the third order component of rotation.

12 Claims, No Drawings

GREASE COMPOSITION FOR CONSTANT VELOCITY JOINTS

BACKGROUND OF THE INVENTION

The present invention relates to a grease composition for constant velocity joints used in motorcars, in particular, for tripod type constant velocity joints.

The constant velocity joint is in general used in a rotation axis for transmitting a driving force from a final reduction gear to a wheel axle of a motorcar and, in particular, the constant velocity joint called tripod type one comprises a tripod having three axes and three rollers and an outer race having three cylindrical grooves for guiding these rollers, which are connected to each corresponding axis through a plurality of needles. In the tripod type constant velocity joint, the components thereof undergo complicated rolling and sliding motions when the joint rotates under a certain angle, this becomes a cause of slide resistance (axial force) having a period of three times the number of revolutions of the joint in the axial direction, i.e., an axial force proportional to the third order component of rotation and it has been known that this in turn becomes a cause of vibrations of motorcars.

Examples of lubricating greases conventionally used in such tripod type constant velocity joints include a grease comprising a calcium complex soap as a thickening agent; and a grease comprising a lithium soap, as a thickening agent, and a sulfur-phosphorus extreme pressure agent selected from the group consisting of, for instance, sulfurized fats and oils and, tricresyl phosphate and zinc dialkyldithiophosphate. In these greases, a lubricating oil is used as a base oil. The axial force proportional to the third order component of rotation is generated due to the internal friction observed during the complicated rolling and sliding motions of the components of a tripod type constant velocity joint.

SUMMARY OF THE INVENTION

Accordingly, an object of the present invention is to provide a grease composition for constant velocity joints which has a friction coefficient smaller than those observed for the conventional greases and which permits the reduction of internal friction of the constant velocity joints and accordingly permits the reduction of the vibrational motions thereof.

Another object of the present invention is to provide a grease composition for tripod type constant velocity joints which can effectively lubricate the constant velocity joints of this type to thus efficiently reduce frictional force and to efficiently inhibit the occurrence of any vibration.

The inventors of this invention have conducted various studies to develop a grease composition capable of reducing frictional force acting on a constant velocity joint, in particular, a tripod type one and inhibiting any vibration thereof and carried out a quality evaluation of greases using an SRV (Schwingungs Reibung und Verschleiss) tester known as the vibration friction/wear tester. As a result, the inventors have found out that there is a specific correlation between the vibration generated by the real constant velocity joints as a vibration-generating source and the friction coefficient observed under specific vibration and friction conditions as determined by the SRV tester. Moreover, the inventors have investigated various combinations of lithium soap or lithium complex soap, as a thickening agent, with various kinds of extreme pressure agents or the like, in the light of the foregoing relation, and found that the foregoing object of the present invention can be accomplished through the use of a specific combination of selected compounds and thus have completed the present invention.

According to the present invention, there is provided a grease composition for constant velocity joints which comprises (a) a base oil; (b) a lithium-containing thickener selected from the group consisting of lithium soap and lithium complex soap; (c) an organic molybdenum compound selected from the group consisting of molybdenum dithiophosphates and molybdenum dithiocarbamates; (d) a zinc dithiophosphate; (e) a sulfur-phosphorus extreme pressure agent free of any metal; and (f) a calcium salt selected from the group consisting of calcium salts of oxidized waxes, calcium salts of petroleum sulfonates and calcium salts of alkyl aromatic sulfonates.

The grease composition comprising a specific combination of the foregoing components permits a substantial reduction in the friction coefficient and a marked reduction in the axial force proportional to the third order component of rotation even when the composition is subjected to a vibration-determining test using a real joint.

DESCRIPTION OF THE PREFERRED EMBODIMENTS

The present invention will hereunder be described in more detail.

First of all, the base oil as the component (a) used in the grease composition for constant velocity joints of the present invention is not restricted to specific ones, but preferably selected from the group consisting of lubricating oils such as mineral oils, hydrocarbon type synthetic oils, ester type synthetic oils and other type synthetic oils and mixtures thereof.

The lithium-containing thickener as the component (b) used in the grease composition is selected from the group consisting of lithium soaps for general-purpose, which have been widely used, such as lithium salts of 12-hydroxystearic acid and stearic acid and lithium complex soaps such as lithium soaps of, for instance, 12-hydroxystearic acid and dibasic acids such as azelaic acid. In this respect, if the lithium complex soap is used, the heat resistance of the resulting grease composition can further substantially be improved.

The organic molybdenum compound as the component (c) of the grease composition is selected from the group consisting of molybdenum dithiophosphates, preferably those represented by the following general formula (I):

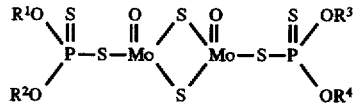

(I)

wherein $R^1$, $R^2$, $R^3$ and $R^4$ each independently represents a primary or secondary alkyl group having 1 to 24, preferably 3 to 20 carbon atoms or an aryl group having 6 to 30, preferably 8 to 18 carbon atoms and molybdenum dithiocarbamates, preferably those represented by the following general formula (II):

$$[(R^5)(R^6)N—CS—S]_2—Mo_2OmSn \quad \text{(II)}$$

wherein $R^5$ and $R^6$ each independently represents an alkyl group having 1 to 24, preferably 3 to 18 carbon atoms; m ranges from 0 to 3 and n ranges from 4 to 1, provided that m+=4. These organic molybdenum compounds may be used alone or in any combination.

The zinc dithiophosphate as the component (d) of the grease composition is an extreme pressure agent, preferably selected from the group consisting of those represented by the following general formula (III):

$$(R^7O)(i\ R^8O)SP—S—Zn—S—PS(CR^9)(OR^{10}) \quad \text{(III)}$$

wherein $R^7$, $R^8$, $R^9$ and $R^{10}$ may be the same or different and each represents an alkyl group having 1 to 24, preferably 3 to 20 carbon atoms or an aryl group having 6 to 30, preferably 8 to 18 carbon atoms. The alkyl group may be a primary or secondary alkyl group. In particular, excellent effect can be expected if the substituents $R^7$, $R^8$, $R^9$ and $R^{10}$ represent a primary or secondary alkyl groups each having 3 to 8 carbon atoms.

Moreover, the sulfur-phosphorus extreme pressure agent free of any metal used as the component (e) has a content of sulfur components ranging from 15 to 35% by weight and a content of phosphorus components ranging from 0.5 to 3% by weight and can impart wear-resistant effect and seizure-inhibitory effect on the resulting grease composition due to the well-balanced ratio of the sulfur components to the phosphorus components. More specifically, if the content of the sulfur components exceeds the upper limit defined above, metals to which the resulting grease composition is applied are liable to be easily corroded, while if the content of the phosphorus components exceeds the upper limit defined above, the metals become worn, i.e., an intended wear-resistant effect cannot be expected. On the other hand, if these contents are less than the corresponding lower limits defined above, any intended effect of the present invention cannot be expected.

The calcium salt used in the invention as the component (f) is at least one member selected from the group consisting of calcium salts of oxidized waxes, calcium salts of petroleum sulfonates which are obtained by sulfonation of aromatic hydrocarbon components present in fractions of lubricating oils and calcium salts of alkyl aromatic sulfonates, for instance, calcium salts of synthetic sulfonic acids such as dinonylnaphthalenesulfonic acid and alkylbenzenesulfonic acids, as well as calcium salts of overbasic synthetic sulfonic acids. These calcium salts are all widely known as rust inhibitors. An excellent effect can be ensured through the use of, in particular, calcium salts of oxidized waxes.

In the present invention, substantially excellent effects can be ensured by the use of a combination of (a) a base oil, (b) a lithium thickener, (c) an organic molybdenum compound, (d) a zinc dithiophosphate, (e) a sulfur-phosphorus extreme pressure agent free of any metal and (f) a calcium salt in a specific compounding ratio as compared with the effects achieved through the use of these components separately and thus the intended objects of the present invention can satisfactorily be accomplished.

The reason why the foregoing effect can be accomplished by the foregoing grease composition would be as follows, although any positive evidence was not secured. It has been known that both of the organic molybdenum compound as the component (c) and the zinc dithiophosphate as the component (d) undergo self-decomposition on the surface to be lubricated to thus form a film of a high molecular weight compound having viscoelasticity. The high molecular weight compound covers the metallic parts on the portions to be lubricated and accordingly, would show synergistic effect of absorbing vibrations and reducing frictional force acting on parts to be lubricated through easy shearing thereof due to complicated rolling and sliding motions of the parts.

In addition to the foregoing effects, the organic molybdenum compound as the component (c) easily form, through the self-decomposition in the presence of the sulfur components, molybdenum disulfide which serves to reduce the frictional force acting on the parts or any wear thereof under a high surface pressure.

The component (e) comprises the sulfur components and phosphorus components in a well-balanced mixing ratio, permits further improvement in the frictional force-reducing effect of the components (c) and (d) and also serves to promote, for instance, the formation of the foregoing high molecular weight film.

The component (f), i.e., a calcium salt selected from the group consisting of calcium salts of oxidized waxes, calcium salts of petroleum sulfonates and calcium salts of alkyl aromatic sulfonates is in general used as a rust inhibitor and shows a rust-inhibitory effect due to the protection of the metallic surface on the face to be lubricated through adsorption thereof on the metallic surface. In the present invention, however, it can be considered that the calcium salt is uniformly distributed throughout the face to be lubricated and the calcium compound can make the friction-reducing effect of the other components more effective through the wear-inhibitory effect of calcium atoms, without impairing the effects achieved by the components other than the component (f).

The grease composition for constant velocity joints of the present invention comprises, on the basis of the total weight of the composition, 60 to 96% by weight, preferably 77 to 91% by weight of the basic oil as the component (a); 2 to 15% by weight, preferably 5 to 10% by weight of the lithium-containing thickening agent as the component (b); 0.5 to 10% by weight, preferably 2 to 5% by weight of the organic molybdenum compound as the component (c); 0.5 to 5% by weight, preferably 1 to 3% by weight of the zinc dithiophosphate as the component (d); 0.1 to 5% by weight, preferably 0.3 to 2% by weight of the sulfur-phosphorus extreme pressure agent free of any metal; and 0.5 to 5% by weight, preferably 1 to 3% by weight of the calcium salt as the component (e).

In this respect, if the content of the component (b) is less than 2% by weight, the component does not serve as a thickener and never provides a desired grease composition. On the other hand, if it exceeds 15% by weight, the resulting grease composition is too hard to ensure the intended effect. If the content of the component (c) is less than 0.5% by weight, that of the component (d) is less than 0.5% by weight, that of the component (e) is less than 0.1% by weight and that of the component (f) is less than 0.5% by weight, the resulting grease composition does not exhibit the intended effect of the present invention, while even if the content of the component (c) exceeds 10% by weight, the content of the component (d) exceeds 5% by weight, the content of the component (e) exceeds 5% by weight and the content of the component (f) exceeds 5.0% by weight, any further improvement in the effect cannot be expected. The grease composition of the present invention may optionally comprise an antioxidant, a rust inhibitor and/or a corrosion inhibitor, in addition to the foregoing essential components.

The present invention will hereunder be described in more detail with reference to the following working Examples and Comparative Examples, but the present invention is not restricted to these specific Examples.

EXAMPLES 1 TO 4 AND 6 TO 9 AND COMPARATIVE EXAMPLES 1 TO 3

A base oil (2500 g) was mixed with 12-hydroxystearic acid (500 g). The mixture was heated to 80° C. A 50% aqueous lithium hydroxide solution (140 g) was added to the mixture and stirred for 30 minutes to cause saponification. Then the mixture was heated to 210° C., after which it was cooled to 160° C. The base oil (1930 g) was further added to the mixture and cooled to not less than 100° C. with stirring to prepare a base lithium grease.

Additives listed in the following Table 1 or 2 were added to the base lithium grease in amounts defined in Table 1 or 2, followed by optional addition of a base oil, mixing in a three-stage roll mill to adjust the consistency of the mixture to No. 1 Grade to thus give grease compositions.

EXAMPLE 5

A base oil (500 g) was mixed with 12-hydroxystearic acid (90 g) and azelaic acid (30 g). The mixture was heated to 65° to 75° C. A 50% aqueous lithium hydroxide solution (55 g) was added to the mixture followed by reaction of these ingredients for 10 minutes. Then the mixture was reacted by heating to 95° to 120° C. for 30 minutes, after which it was cooled to 210° C. and maintained at that temperature for 10 minutes and then cooled. The base oil (352.5 g) was added to the mixture and stirred with cooling to give a base lithium complex grease.

Additives listed in the following Table 1 or 2 were added to the base lithium complex grease in amounts defined in Table 1 or 2, mixed in a three-stage roll mill to adjust the consistency of the mixture to No. 1 Grade to thus give grease composition.

The base oil used in the grease compositions of these Examples and Comparative Examples has the following composition:

| | |
|---|---|
| Kind of Base Oil: | mineral oil |
| Viscosity: | 60.6 $mm^2/s$ (at 40° C.)<br>7.7 $mm^2/s$ (at 100° C.) |
| Viscosity Index: | 88 |

Moreover, a commercially available lithium grease containing a sulfur-phosphorus extreme pressure agent was used as the grease of Comparative Example 4 and a commercially available calcium complex grease was used as the grease of Comparative Example 5.

Physical properties of these greases were evaluated according to the method detailed below. The results thus obtained are also listed in Tables 1 and 2.

[Consistency] This was determined according to the method defined in ISO 2137.

| [SRV Test] | | |
|---|---|---|
| Test Piece: | ball | diameter: 10 mm (SUJ-2) |
| | cylindrical plate | diameter 24 mm × 7.85 mm (SUJ-2) |
| Conditions for Evaluation: | | |
| Load | 50N, 100N, 200N, 300N, 400N, 500N (After operating one minute at a load of 50N, then the load to be applied was increased 100N by 100N and the SRV tester was operated for one minute at each load.) | |
| Frequency: | 15 Hz | |
| Amplitude: | 1000 μm | |
| Time: | 6 minutes | |
| Test Temperature: | room temperature | |
| Item to be Determined: | Overall averaged value of friction coefficient for each load | |

Conditions for Evaluation:

Load 50N, 100N, 200N, 300N, 400N, 500N (After operating one minute at a load of 50N, then the load to be applied was increased 100N by 100N and the SRV tester was operated for one minute at each load.)

Frequency: 15 Hz

Amplitude: 1000 μm

Time: 6 minutes

Test Temperature: room temperature

Item to be Determined: Overall averaged value of friction co-efficient for each load

[Axial Force-Determining Test]

In respect of vibrations of real joints, the slide resistance of a tripod type constant velocity joint in the axial direction during rotation was determined and this was defined to be the axial force. The rate of reduction in the axial force at each angle was determined on the basis of the results thus obtained while using the value observed for the commercially available calcium complex grease of Comparative Example 5 as a standard and the average of the values obtained at three angles was defined to be an averaged rate of reduction in the axial force.

| Conditions for Determination | |
|---|---|
| Number of Revolutions: | 300 rpm |
| torque: | 637N · m |
| Angle of Joint: | 6°, 8°, 10° |
| Measurement Time: | After the operation of 10 minutes |

TABLE 1

| Component | Example No. 1 | 2 | 3 | 4 | 5 | 6 | 7 | 8 | 9 |
|---|---|---|---|---|---|---|---|---|---|
| (1) | 92.5 | 92.5 | 92.5 | 92.5 | — | 93.5 | 93.5 | 92.5 | 92.5 |
| (2) | — | — | — | — | 92.5 | — | — | — | — |
| (3) | 3.0 | 3.0 | 3.0 | 3.0 | 3.0 | 3.0 | — | 3.0 | 3.0 |
| (4) | — | — | — | — | — | — | 3.0 | — | — |
| (5) | 1.0 | 1.0 | 1.0 | 1.0 | 1.0 | — | — | 1.0 | 1.0 |
| (6) | 1.0 | 1.0 | 1.0 | 1.0 | 1.0 | 1.0 | 1.0 | — | — |
| (7) | — | — | — | — | — | — | — | 1.0 | — |
| (8) | — | — | — | — | — | — | — | — | 1.0 |
| (9) | 0.5 | 0.5 | 0.5 | 0.5 | 0.5 | 0.5 | 0.5 | 0.5 | 0.5 |
| (10) | 2.0 | — | — | — | 2.0 | 2.0 | 2.0 | 2.0 | 2.0 |
| (11) | — | 2.0 | — | — | — | — | — | — | — |
| (12) | — | — | 2.0 | — | — | — | — | — | — |
| (13) | — | — | — | 2.0 | — | — | — | — | — |
| Evaluation Test | | | | | | | | | |
| (14) | 322 | 325 | 327 | 324 | 317 | 319 | 323 | 319 | 327 |
| (15) | 0.032 | 0.035 | 0.036 | 0.035 | 0.033 | 0.035 | 0.037 | 0.033 | 0.037 |
| (16) | −32 | −25 | −27 | −26 | −30 | −23 | −20 | −31 | −22 |

TABLE 2

| Component | Comparative Example No. 1 | 2 | 3 | 4* | 5** |
|---|---|---|---|---|---|
| (1) | 95.5 | 94.5 | 93.5 | | |
| (2) | — | — | — | | |
| (3) | 3.0 | 3.0 | — | | |
| (4) | — | — | 3.0 | | |
| (5) | — | 1.0 | — | | |
| (6) | 1.0 | 1.0 | 1.0 | | |
| (7) | — | — | — | | |
| (8) | — | — | — | | |
| (9) | 0.5 | 0.5 | 0.5 | | |
| (10) | — | — | — | | |
| (11) | — | — | — | | |
| (12) | — | — | — | | |
| (13) | — | — | — | | |

TABLE 2-continued

| Component | Comparative Example No. 1 | 2 | 3 | 4* | 5** |
|---|---|---|---|---|---|
| Evaluation Test | | | | | |
| (14) | 324 | 318 | 323 | 295 | 282 |
| (15) | 0.040 | 0.041 | 0.043 | 0.080 | 0.082 |
| (16) | −13 | −14 | −9 | +1 | standard |

*: A lithium frame comprising a commercially available sulfur-phosphorus extreme pressure agent.
**: Commercially available calcium complex grease.
Note:
(1) base lithium grease
(2) base lithium complex grease
(3) molybdenum dithiophosphate (Molyvan L, available from R. T. Vanderbilt Company)
(4) molybdenum dithiocarbamate (Molyvan A, available from R. T. Vanderbilt Company)
(5) molybdenum dithiocarbamate (Molyvan 822, available from R. T. Vanderbilt Company)
(6) zinc dithiophosphate I (Lubrizol 1360, available from Nippon Lubrizol Co., Ltd.)
(7) zinc dithiophosphate II (TLA 111, available from Texaco Company)
(8) zinc dithiophosphate III (TLA 252, available from Texaco Company)
(9) Sulfur-phosphorus extreme pressure agent (Mobilad G-305, available from Mobil Chemical Company)
(10) calcium salt of oxidized wax (Alox 165, available from Alox Corporation)
(11) calcium salt of petroleum sulfonate (Sulfol Ca-45, available from Matsumura Petroleum Laboratory Co., Ltd.)
(12) calcium salt of dinonylnaphthalenesulfonate (NA-SUL 729, available from KING INDUSTRIES Co., Ltd.)
(13) calcium overbasic alkylbenzenesulfonate (BRYTON C-400, available from WITCO CHEMICAL Company)
(14) Consistency: 60 W
(15) SRV Test: averaged frictional coefficient
(16) Axial Force Measuring Test: Rate (%) of reduction in averaged axial force As has been explained above in detail, the grease composition for constant velocity joints according to the present invention comprises (a) a base oil, (b) a lithium-containing thickener selected from the group consisting of lithium soaps and lithium complex soaps, (c) an organic molybdenum compound selected from the group consisting of molybdenum dithiophosphates and molybdenum dithiocarbamates, (d) a zinc dithiophosphate, (e) a sulfur-phosphorus extreme pressure agent free of any metal and (f) a calcium salt selected from the group consisting of calcium salts of oxidized waxes, calcium salts of petroleum sulfonates and calcium salts of alkyl aromatic sulfonates, in a predetermined compounding ratio, and accordingly, exhibits a substantially improved effect of reducing friction coefficient and a substantially improved effect of reducing the axial force proportional to the third order component of rotation as is clear from the test results of Examples and Comparative Examples listed in Tables 1 and 2.

What is claimed is:

1. A grease composition for constant velocity joints, which comprises:

(a) 60 to 96% by weight of a base oil;

(b) 2 to 15% by weight of a lithium-containing thickener selected from the group consisting of lithium soap and lithium complex soap;

(c) 0.5 to 10% by weight of an organic molybdenum compound selected from the group consisting of molybdenum dithiophosphates and molybdenum dithiocarbamates;

(d) 0.5 to 5% by weight of a zinc dithiophosphate;

(e) 0.1 to 5% by weight of a sulfur-phosphorus extreme pressure agent free of any metal; and (f) 0.5 to 5% by weight of a calcium salt selected from the group consisting of calcium salts of oxidized waxes calcium salts of petroleum sulfonates and calcium salts of alkyl aromatic sulfonates.

2. The grease composition for constant velocity joints of claim 1 wherein it comprises 77 to 91% by weight of the base oil; 5 to 10% by weight of the lithium-containing thickener; 2 to 5% by weight of the organic molybdenum compound; 1 to 3% by weight of the zinc dithiophosphate; 0.3 to 2% by weight of the sulfur-phosphorus extreme pressure agent free of any metal; and 1 to 3% by weight of the calcium salt.

3. The grease composition for constant velocity joints of claim 1, wherein said organic molybdenum compound is a mixture of a molybdenum dithiophosphate and a molybdenum dithiocarbamate.

4. The grease composition for constant velocity joints of claim 1, wherein said sulfur-phosphorus extreme pressure agent free of any metal has a content of sulfur component ranging from 15 to 35% by weight and a content of phosphorus component ranging from 0.5 to 3% by weight.

5. The grease composition for constant velocity joints of claim 1, wherein said calcium salt is selected from calcium salts of oxidized waxes.

6. The grease composition for constant velocity joints of claim 1 wherein the molybdenum dithiophosphate is a member selected from the group consisting of those represented by the following general formula (I):

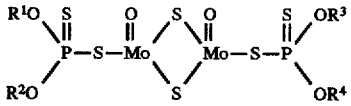

(I)

wherein $R^1$, $R^2$, $R^3$ and $R^4$ each independently represents a primary or secondary alkyl group having 1 to 24 carbon atoms or an aryl group having 6 to 30 carbon atoms.

7. The grease composition for constant velocity joints of claim 6, wherein $R^1$, $R^2$, $R^3$ and $R^4$ each independently represents a primary or secondary alkyl group having 3 to 20 carbon atoms or an aryl group having 8 to 18 carbon atoms.

8. The grease composition for constant velocity joints of claim 1, wherein the molybdenum dithiocarbamate is a member selected from the group consisting of those represented by the following general formula (II):

$$[(R^5)(R^6)N—CS—S]_2—Mo_2O_mS_n \quad (II)$$

wherein $R^5$ and $R^6$ each independently represents an alkyl group having 1 to 24 carbon atoms; m ranges from 0 to 3 and n ranges from 4 to 1, provided that m+n=4.

9. The grease composition for constant velocity joints of claim 8, wherein $R^5$ and $R^6$ each independently represents an alkyl group having 3 to 18 carbon atoms.

10. The grease composition for constant velocity joints of claim 1, wherein said zinc dithiophosphate is an extreme pressure agent, selected from the group consisting of those represented by the following general formula (III):

$$(R^7O)(R^8O)SP—S—Zn—S—PS(OR^9)(OR^{10}) \quad (III)$$

wherein $R^7$, $R^8$, $R^9$ and $R^{10}$ may be the same or different and each represents an alkyl group having 1 to 24 carbon atoms or an aryl group having 6 to 30 carbon atoms.

11. The grease composition for constant velocity joints of claim 10, wherein $R^7$, $R^8$, $R^9$ and $R^{10}$ may be the same or different and each represents an alkyl group having 3 to 20 carbon atoms or an aryl group having 8 to 18 carbon atoms.

12. The grease composition for constant velocity joints of claim 10, wherein $R^7$, $R^8$, $R^9$ and $R^{10}$ represent a primary or secondary alkyl groups each having 3 to 8 carbon atoms.

* * * * *